US008064803B2

(12) United States Patent
Kuroda et al.

(10) Patent No.: US 8,064,803 B2
(45) Date of Patent: Nov. 22, 2011

(54) CHARGING MEMBER, PROCESS CARTRIDGE, AND ELECTROPHOTOGRAPHIC APPARATUS

(75) Inventors: Noriaki Kuroda, Suntou-gun (JP); Yoko Kuruma, Mishima (JP); Hisao Kato, Ashigarakami-gun (JP); Toshiro Suzuki, Odawara (JP); Jun Murata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 676 days.

(21) Appl. No.: 12/280,982

(22) PCT Filed: Feb. 23, 2007

(86) PCT No.: PCT/JP2007/053986

§ 371 (c)(1),
(2), (4) Date: Aug. 27, 2008

(87) PCT Pub. No.: WO2007/100070

PCT Pub. Date: Sep. 7, 2007

(65) Prior Publication Data

US 2009/0067880 A1 Mar. 12, 2009

(30) Foreign Application Priority Data

Feb. 28, 2006 (JP) ..... 2006-052870

(51) Int. Cl.
*G03G 15/02* (2006.01)

(52) U.S. Cl. ..... 399/176; 399/111

(58) Field of Classification Search ..... None
See application file for complete search history.

(56) References Cited

U.S. PATENT DOCUMENTS

| | | | | |
|---|---|---|---|---|
| 4,420,548 | A | 12/1983 | Sakai et al. | 430/59 |
| 4,906,718 | A | 3/1990 | Gornowicz et al. | 528/15 |
| 5,725,922 | A | 3/1998 | Nakamura et al. | 428/36.9 |
| 6,142,922 | A | 11/2000 | Yoshikawa et al. | 492/56 |
| 6,475,584 | B1 | 11/2002 | Tsuchiya et al. | 428/36.91 |
| 6,559,210 | B2 | 5/2003 | Murata | 524/251 |
| 6,962,746 | B2 | 11/2005 | Taniguchi et al. | 428/323 |
| 2001/0055687 | A1 | 12/2001 | Hoshi | 428/423.9 |
| 2004/0265007 | A1 * | 12/2004 | Hara | 399/176 |

(Continued)

FOREIGN PATENT DOCUMENTS

| | | | |
|---|---|---|---|
| CN | 1243523 | A | 2/2000 |

(Continued)

OTHER PUBLICATIONS

Chinese Office Action issued in the counterpart application No. 200780007043.0 dated May 17, 2010 along with English-language translation—24 pages.

*Primary Examiner* — David Gray
*Assistant Examiner* — Roy Y Yi
(74) *Attorney, Agent, or Firm* — Fitzpatrick, Cella, Harper & Scinto

(57) ABSTRACT

A charging member having a support, a conductive elastic layer formed on the support and a surface layer formed on the conductive elastic layer, wherein the surface layer contains a polysiloxane having an acrylic group and an oxyalkylene group. This provides a charging member to the surface of which toners and external additives used in the toners can not easily cling even because of repeated use over a long period of time and which therefore enables charging and image reproduction which are stable over a long period of time, even when used in the DC contact charging method; and further provides a process cartridge and an electrophotographic apparatus which have such a charging member.

15 Claims, 2 Drawing Sheets

U.S. PATENT DOCUMENTS

2007/0217823 A1 9/2007 Kuroda et al. ..... 399/174

FOREIGN PATENT DOCUMENTS

CN 1453651 A 11/2003
EP 0 372 584 A2 6/1990
EP 0 982 335 A1 3/2000
EP 1 156 388 A1 11/2001
EP 1 355 199 A2 10/2003
JP 2000-267394 9/2000
JP 2004-210857 7/2004

* cited by examiner

CHARGING MEMBER, PROCESS CARTRIDGE, AND ELECTROPHOTOGRAPHIC APPARATUS

TECHNICAL FIELD

This invention relates to a charging member, and a process cartridge and an electrophotographic apparatus which have the charging member.

BACKGROUND ART

At present, a contact charging method has been put into practical use as one of methods for charging the surface of an electrophotographic photosensitive member electrostatically.

The contact charging method is a method in which a voltage is applied to a charging member disposed in contact with the electrophotographic photosensitive member, to cause micro-discharge at the part of contact between the charging member and the electrophotographic photosensitive member and the vicinity thereof to charge the surface of the electrophotographic photosensitive member electrostatically.

As the charging member for charging the surface of the electrophotographic photosensitive member electrostatically, from the viewpoint of sufficiently securing a contact nip between the electrophotographic photosensitive member and the charging member, what is common is one having a support and an elastic layer (conductive elastic layer) provided on the support.

The elastic layer (conductive elastic layer) often contains low-molecular weight components in a relatively large quantity, and hence such low-molecular weight components may bleed out to contaminate the surface of the electrophotographic photosensitive member. In order to control this contamination due to bleed-out, it is also prevalent to provide on the conductive elastic layer a surface layer different therefrom and having a lower modulus of elasticity than the conductive elastic layer.

As the shape of the charging member, what is common is the shape of a roller. Hereinafter, the roller-shaped charging member is also called "charging roller").

Of the contact charging method, a method having come into wide use is a method in which a voltage formed by superimposing an alternating-current voltage on a direct-current voltage is applied to the charging member (hereinafter also "AC+DC contact charging method"). In the case of the AC+DC contact charging method, a voltage having a peak-to-peak voltage that is twice or more the voltage at which the charging is started is used as the alternating-current voltage.

The AC+DC contact charging method is a method by which stable charging in a high charging uniformity can be performed because of the use of the alternating-current voltage. However, insofar as an alternating-current voltage source is used, this method brings about a charging assembly and an electrophotographic apparatus which are large in size and a rise in cost, compared with a method in which a voltage of direct-current voltage only is applied to the charging member (hereinafter also "DC contact charging method").

That is, the DC contact charging method is superior to the AC+DC contact charging method in respect of making the charging assembly and electrophotographic apparatus small-sized and achievement of cost reduction.

Japanese Patent Application Laid-open No. 2004-210857 (Patent Document 1) discloses production of an elastic material having superior surface properties and releasability and having a low hardness and a heat resistance. More specifically, a solution of an organosilicon compound having at one terminal or both terminals a functional group or groups capable of reacting with a metal alkoxide is heat-treated to remove its water content and low-molecular weight components, the metal alkoxide is added to the organosilicon compound solution thus heat-treated, to prepare an organic-inorganic hybrid sol, then the sol is heated into a gel, and a substrate is, e.g., coated with the resultant organic-inorganic hybrid material to produce the elastic material having superior surface properties and releasability and having a low hardness and a heat resistance. This elastic material is useful as a material for roll members and belt members of copying machines and printers of electrophotographic systems, as so disclosed.

Japanese Patent Application Laid-open No. 2000-267394 (Patent Document 2) discloses a charging member which is brought into contact with a charging object and with which the charging object is electrostatically charged by applying a voltage across the charging member and the charging object. In this charging member, at least its member surface coming into contact with the charging object is formed of a surface layer having a binder and an additive added thereto which has a fluorine block copolymer or silicon block copolymer having a first block of a fluorine type or silicon type and a second block containing neither fluorine nor silicon. This charging member further has low friction properties and superior toner adhesion properties and besides exhibit a superior running performance, as so disclosed.

DISCLOSURE OF THE INVENTION

However, the DC contact charging method has not any effect of improving charge uniformity which is due to alternating-current voltage. Hence, surface contamination (due to toners and external additives used in the toners) of the charging member and electrical resistance non-uniformity of the charging member itself tend to appear on reproduced images.

Especially in the case of the DC contact charging method, toners and external additives used in the toners adhere (cling) non-uniformly and strongly to the surface of the charging member because of repeated use. As the result, the part to which they have clung may cause supercharging or faulty charging when halftone images are reproduced in a high-temperature and high-humidity environment (30° C./80% RH).

An object of the present invention is to provide a charging member to the surface of which toners and external additives used in the toners can not easily cling even because of repeated use over a long period of time and which therefore enables charging and image reproduction which are stable over a long period of time, even when used in the DC contact charging method. A further object of the present invention is to provide a process cartridge and an electrophotographic apparatus which have such a charging member.

The present invention is a charging member having a support, a conductive elastic layer formed on the support and a surface layer formed on the conductive elastic layer, wherein the surface layer contains a polysiloxane having an acrylic group and an oxyalkylene group.

The present invention is also a process cartridge and an electrophotographic apparatus which have the above charging member.

According to the present invention, toners and external additives used in the toners can not easily cling even because of repeated use over a long period of time. Also, though unclear in the present state of affairs, the surface layer itself can maintain transparency in virtue of close refractive indexes between the acrylic group moiety and the polysiloxane moiety. This allows to expect that wavelength dispersibility may come small in the low wavelength region when cured with active energy rays, in particular, ultraviolet rays. Hence, the conductive elastic layer is simultaneously modified to bring an improvement in charging uniformity, as so presumed. Thus, according to the present invention, it can provide the charging member which enables charging and image reproduction which are stable over a long period of time, even when used in the DC contact charging method, and the process cartridge and the electrophotographic apparatus which have such a charging member.

BEST MODES FOR CARRYING OUT THE INVENTION

The charging member of the present invention has a support, a conductive elastic layer formed on the support and a surface layer formed on the conductive elastic layer.

The simplest construction of the charging member of the present invention is that the two layers, the conductive elastic layer and the surface layer, are provided on the support. One or two or more different layers may also be provided between the support and the conductive elastic layer or between the conductive elastic layer and the surface layer.

Figure 1:
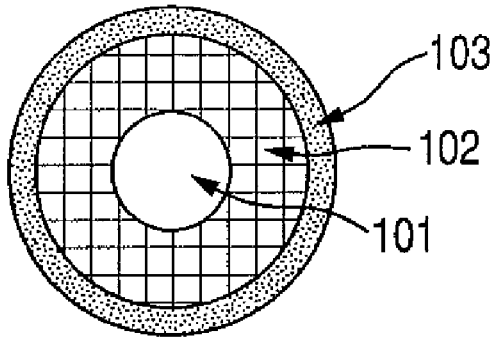
FIG. 1 illustrates an example of the construction of the charging member of the present invention.

FIG. 1 shows an example of the construction of the charging member of the present invention. The charging member shown in FIG. 1 has a support 101, a conductive elastic layer 102 and a surface layer 103.

As the support of the charging member, it may at least have conductivity (conductive support). For example, a support made of a metal (or made of an alloy) such as iron, copper, stainless steel, aluminum, an aluminum alloy or nickel may be used. For the purpose of providing scratch resistance, surface treatment such as plating may also be applied to the surface of any of these supports as long as its conductivity is not damaged.

In the conductive elastic layer, one or two or more of elastic materials such as rubbers or thermoplastic elastomers may be used which are used in elastic layers (conductive elastic layers) of conventional charging members.

The rubbers may include, e.g., the following: Urethane rubbers, silicone rubbers, butadiene rubbers, isoprene rubbers, chloroprene rubbers, styrene-butadiene rubbers, ethylene-propylene rubbers, polynorbornene rubbers, styrene-butadiene-styrene rubbers, acrylonitrile rubbers, epichlorohydrin rubbers and alkyl ether rubbers.

The thermoplastic elastomer may include, e.g., styrene type elastomers and olefin type elastomers. Commercially available products of the styrene type elastomers may include, e.g., RABARON, a product of Mitsubishi Chemical Corporation, and SEPTON COMPOUND, a product of Kuraray Co., Ltd. Commercially available products of the olefin type elastomers may include, e.g., THERMOLAN, a product of Mitsubishi Chemical Corporation, MILASTOMER, a product of Mitsui Petrochemical Industries, Ltd., SUMITOMO TPE, a product of Sumitomo Chemical Co., Ltd., and SANTOPRENE, a product of Advanced Elastomer Systems, L.P.

A conducting agent may also appropriately be used in the conductive elastic layer. This enables control of its conductivity at a stated value. The electrical resistance of the conductive elastic layer may be controlled by appropriately selecting the type and amount of the conducting agent to be used. The conductive elastic layer may have an electrical resistance of from $10^2\Omega$ or more to $10^8\Omega$ or less as a preferable range, and from $10^3\Omega$ or more to $10^6\Omega$ or less as a more preferable range.

The conducting agent used in the conductive elastic layer may include, e.g., cationic surface-active agents, anionic surface-active agents, amphoteric surface-active agents, antistatic agents and electrolytes.

The cationic surface-active agents may include, e.g., the following: Salts of quaternary ammoniums such as lauryl trimethylammonium, stearyl trimethylammonium, octadodecyl trimethylammonium, dodecyl trimethylammonium, hexadecyl trimethylammonium, and modified fatty acid dimethyl ethylammonium.

The salts of the quaternary ammoniums may include, e.g., the following: Perchlorate, chlorate, tetrafluoroborate, ethosulfate and benzyl halides (such as benzyl bromide and benzyl chloride).

The anionic surface-active agents may include, e.g., aliphatic sulfonates, higher alcohol sulfates, higher alcohol ethylene oxide addition sulfates, higher alcohol phosphates, and higher alcohol ethylene oxide addition phosphates.

The antistatic agents may include, e.g., nonionic antistatic agents such as higher alcohol ethylene oxides, polyethylene glycol fatty esters, and polyhydric alcohol fatty esters.

The electrolytes may include, e.g., salts (such as quaternary ammonium salts) of metals belonging to Group 1 of the periodic table (such as Li, Na and K). The salts of metals belonging to Group 1 of the periodic table may include, e.g., $LiCF_3SO_3$, $NaClO_4$, $LiAsF_6$, $LiBF_4$, NaSCN, KSCN and NaCl.

As the conducting agent for the conductive elastic layer, also usable are salts (such as $Ca(ClO_4)_2$) of metals belonging to Group 2 of the periodic table (such as Ca and Ba), and antistatic agents derived therefrom. Still also usable are ion-conductive conducting agents such as complexes of any of these with polyhydric alcohols (such as 1,4-butanediol, ethylene glycol, polyethylene glycol, propylene glycol and polyethylene glycol) or derivatives thereof, and complexes of the above with monools (such as ethylene glycol monomethyl ether and ethylene glycol monoethyl ether).

As the conducting agent for the conductive elastic layer, also usable are conductive carbons such as KETJEN BLACK EC, acetylene black, rubber-purpose carbon, color(ink)-purpose carbon having been treated by oxidation, and thermally decomposed carbon. The rubber-purpose carbon may specifically include, e.g., the following: Super Abrasion Furnace (SAF: super-resistance to abrasion), Intermediate Super Abrasion Furnace (ISAF: intermediate super-resistance to abrasion), High Abrasion Furnace (HAF: high resistance to abrasion), Fast Extruding Furnace (FEF: good extrudability), General Purpose Furnace (GPF: general-purpose properties), Semi Reinforcing Furnace (SRF: semi-reinforcing properties), Fine Thermal (FT: fine-particle thermally decomposed), and Medium Thermal (MT: medium-particle thermally decomposed).

Graphites such as natural graphite and artificial graphite may also be used as the conducting agent for the conductive elastic layer.

Metal oxides such as tin oxide, titanium oxide and zinc oxide and metals such as nickel, copper, silver and germanium may also be used as the conducting agent for the conductive elastic layer.

Conductive polymers such as polyaniline, polypyrrole and polyacetylene may further be used as the conducting agent for the conductive elastic layer.

An inorganic or organic filler and a cross-linking agent may be added to the conductive elastic layer. Such a filler may include, e.g., silica (white carbon), potassium carbonate, magnesium carbonate, clay, talc, zeolite, alumina, barium sulfate and aluminum sulfate. The cross-linking agent may include, e.g., sulfur, peroxides, cross-linking auxiliaries, cross-linking accelerators, cross-linking acceleration auxiliaries, and cross-linking retarders.

From the viewpoint of keeping the charging member from being deformed when the charging member and the charging object electrophotographic photosensitive member are brought into contact with each other, the conductive elastic layer may have a hardness of 70 degrees or more as Asker-C hardness, and, in particular, more preferably 73 degrees or more.

From the viewpoint of sufficiently bringing out the function of the conductive elastic layer provided in order to secure a contact nip between the electrophotographic photosensitive member and the charging member, the surface layer of the charging member may preferably have a modulus of elasticity of 2,000 MPa or less. On the other hand, since, in general, layers show a tendency to have a smaller cross-linking density as the layers have a smaller modulus of elasticity, the surface layer of the charging member may preferably have a modulus of elasticity of 100 MPa or more, from the viewpoint of keeping the surface of the electrophotographic photosensitive member from being contaminated with low-molecular weight components having bled out to the surface of the charging member.

The effect of keeping the low-molecular weight components from bleeding out can be greater as the surface layer has a larger layer thickness, but the charging member may have a lower charging performance as it has a larger layer thickness. Accordingly, taking account of these, in the present invention, the surface layer may preferably have a layer thickness of from 0.01 μm or more to 1.00 μm or less, particularly preferably from 0.04 μm or more to 0.60 μm or less.

To ascertain the layer thickness of the surface layer, the surface portion of the charging member is shaved with a razor, then immersed in liquid nitrogen, and broken. Thereafter, its section is observed on a scanning electron microscope (SEM) (manufactured by JEOL Ltd.) at magnifications of about 20,000.

From the viewpoint of keeping the toners and external additives from clinging to the surface of the charging member, the surface of the charging member (i.e., the surface of the surface layer) may preferably have a roughness (Rz) of 10 μm or less according to JIS 94, more preferably 7 μm or less, and still more preferably 5 μm or less.

The charging member of the present invention is described below.

The charging member of the present invention is, as mentioned above, a charging member having a support, a conductive elastic layer formed on the support and a surface layer formed on the conductive elastic layer, wherein the surface layer contains a polysiloxane having an acrylic group and an oxyalkylene group.

The polysiloxane may preferably be one further having an alkyl group and a phenyl group. This alkyl group may preferably be a straight-chain or branched-chain alkyl group having 1 or more to 21 or less carbon atoms, and may further preferably be a methyl group, an ethyl group, a n-propyl group, a hexyl group or a decyl group.

In the case when the polysiloxane further has an alkyl group and a phenyl group, the acrylic group in the polysiloxane may preferably be in a content of from 1.0% by mass or more to 20.0% by mass or less based on the total mass of the polysiloxane. The oxyalkylene group in the polysiloxane may preferably be in a content of from 4.0% by mass or more to 30.0% by mass or less based on the total mass of the polysiloxane. The alkyl group in the polysiloxane may preferably be in a content of from 5.0% by mass or more to 30.0% by mass or less based on the total mass of the polysiloxane. The phenyl group in the polysiloxane may preferably be in a content of from 5.0% by mass or more to 30.0% by mass or less based on the total mass of the polysiloxane. The siloxane moiety in the polysiloxane may preferably be in a content of from 20.0% by mass or more to 80.0% by mass or less based on the total mass of the polysiloxane.

The polysiloxane may be obtained by condensing by hydrolysis a hydrolyzable silane compound having a cationic-polymerizable group, to obtain a hydrolytic condensation product, and then cleaving the cationic-polymerizable group to cross-link the hydrolytic condensation product.

That is, the polysiloxane may be obtained through the following steps;

(I) the step of condensing by hydrolysis a hydrolyzable silane compound having a cationic-polymerizable group;

(II) the step of adding to the condensation product obtained in the step (I) a compound which is a block copolymer synthesized from an acrylic monomer and a silicon monomer; and (III) the step of cleaving the cationic-polymerizable group to cross-link the hydrolytic condensation product obtained in the step (II).

In the case when the polysiloxane further has an alkyl group and a phenyl group, the polysiloxane may be obtained by condensing by hydrolysis a hydrolyzable silane compound having a cationic-polymerizable group, a hydrolysable silane compound having an alkyl group and a hydrolysable silane compound having a phenyl group, to obtain a hydrolytic condensation product, and then cleaving the cationic-polymerizable group to cross-link the hydrolytic condensation product.

That is, in the case when the polysiloxane further has an alkyl group and a phenyl group, the polysiloxane may be obtained through the following steps;

(VII) the step of condensing by hydrolysis a hydrolyzable silane compound having a cationic-polymerizable group, a hydrolyzable silane compound having an alkyl group and a hydrolyzable silane compound having a phenyl group;

(VIII) the step of adding to the condensation product obtained in the step (VII) a compound which is a block copolymer synthesized from an acrylic monomer and a silicon monomer; and (IX) the step of cleaving the cationic-polymerizable group to cross-link the hydrolytic condensation product obtained in the step (VIII).

As the hydrolyzable silane compound having a cationic-polymerizable group, it may preferably be a hydrolyzable silane compound having a structure represented by the following formula (2).

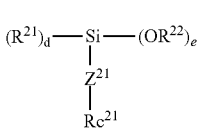

(2)

In the formula (2), $R^{21}$ represents a saturated or unsaturated monovalent hydrocarbon group. $R^{22}$ represents a saturated or unsaturated monovalent hydrocarbon group. $Z^{21}$ represents a divalent organic group. $Rc^{21}$ represents a cationic-polymerizable group. Letter symbol d is an integer of 0 to 2 or less, e is an integer of 1 or more to 3 or less, and d+e is 3.

The cationic-polymerizable group represented by $Rc^{21}$ in the formula (2) is meant to be a cationic-polymerizable organic group capable of forming an oxyalkylene group by cleavage, and may include, e.g., cyclic ether groups such as an epoxy group and an oxetane group, and vinyl ether groups. Of these, an epoxy group is preferred from the viewpoint of ready availability and ready reaction controllability.

As the saturated or unsaturated monovalent hydrocarbon group represented by $R^{21}$ and $R^{22}$ in the formula (2), it may include alkyl groups, alkenyl groups and aryl groups. Of these, it may preferably be a straight-chain or branched-chain alkyl group having 1 or more to 3 or less carbon atoms, and may further preferably be a methyl group or an ethyl group.

The divalent organic group represented by $Z^{21}$ in the formula (2) may include, e.g., alkylene groups and arylene groups. Of these, alkylene groups having 1 or more to 6 or less carbon atoms are preferred, and further an ethylene group is more preferred.

The e in the formula (2) may preferably be 3.

Where the d in the formula (2) is 2, the two $R^{21}$'s may be the same or different.

Where the e in the formula (2) is 2 or 3, the two or three $R^{22}$'s may be the same or different.

Specific examples of the hydrolyzable silane compound having the structure represented by the formula (2) are shown below.

(2-1): Glycidoxypropyltrimethoxysilane
(2-2): Glycidoxypropyltriethoxysilane
(2-3): Epoxycyclohexylethyltrimethoxysilane
(2-4): Epoxycyclohexylethyltriethoxysilane The polysiloxane used in the charging member of the present invention may be obtained by, as described above, condensing by hydrolysis a hydrolyzable silane compound having a cationic-polymerizable group, to obtain a hydrolytic condensation product, and then cleaving the cationic-polymerizable group to cross-link the hydrolytic condensation product. In particular, from the viewpoint of controlling surface properties of the charging member, it is preferable in obtaining the hydrolytic condensation product to further use in combination, in addition to the hydrolyzable silane compound having a cationic-polymerizable group, a hydrolyzable silane compound having a structure represented by the following formula (1).

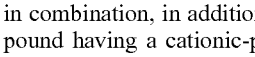

(1)

That is, in the case when a hydrolysable silane compound having a structure represented by the above formula (1) is used in combination in addition to a hydrolysable silane compound having a cationic-polymerizable group, the polysiloxane may be obtained through the following steps;

(IV) the step of condensing by hydrolysis a hydrolyzable silane compound having a cationic-polymerizable group and a hydrolyzable silane compound having a structure represented by the above formula (1);

(V) the step of adding to the hydrolytic condensation product obtained in the step (IV) a compound which is a block copolymer synthesized from an acrylic monomer and a silicon monomer; and (VI) the step of cleaving the cationic-polymerizable group to cross-link the hydrolytic condensation product obtained in the step (V).

In the formula (1), $R^{11}$ represents a phenyl group substituted alkyl group or an unsubstituted alkyl group or an alkyl group substituted aryl group or an unsubstituted aryl group. $R^{12}$ represents a saturated or unsaturated monovalent hydrocarbon group. Letter symbol a is an integer of 0 or more to 3 or less, b is an integer of 1 or more to 4 or less, and a+b is 4.

As the alkyl group of the phenyl group substituted alkyl group or unsubstituted alkyl group represented by $R^{11}$ in the formula (1), it may preferably be a straight-chain alkyl group having 1 or more to 21 or less carbon atoms.

As the aryl group of the alkyl group substituted aryl group or unsubstituted aryl group represented by $R^{11}$ in the formula (1), it may preferably be a phenyl group.

The a in the formula (1) may preferably be an integer of 1 or more to 3 or less, and, in particular, more preferably be 1.

The b in the formula (1) may preferably be an integer of 1 or more to 3 or less, and, in particular, more preferably be 3.

The saturated or unsaturated monovalent hydrocarbon group represented by $R^{12}$ in the formula (1) may include, e.g., alkyl groups, alkenyl groups and aryl groups. Of these, straight-chain or branched-chain alkyl groups having 1 or more to 3 or less carbon atoms are preferred, and may further preferably be a methyl group, an ethyl group or a n-propyl group.

Where the a in the formula (1) is 2 or 3, the two or three $R^{11}$'s may be the same or different.

Where the b in the formula (1) is 2, 3 or 4, the two, three or four $R^{12}$'s may be the same or different.

Specific examples of the hydrolyzable silane compound having the structure represented by the formula (1) are shown below.

(1-1): Tetramethoxysilane
(1-2): Tetraethoxysilane
(1-3): Tetrapropoxysilane
(1-4): Methyltrimethoxysilane
(1-5): Methyltriethoxysilane
(1-6): Methyltripropoxysilane
(1-7): Ethyltrimethoxysilane
(1-8): Ethyltriethoxysilane
(1-9): Ethyltripropoxysilane
(1-10): Propyltrimethoxysilane
(1-11): Propyltriethoxysilane
(1-12): Propyltripropoxysilane
(1-13): Hexyltrimethoxysilane
(1-14): Hexyltriethoxysilane
(1-15): Hexyltripropoxysilane
(1-16): Decyltrimethoxysilane
(1-17): Decyltriethoxysilane
(1-18): Decyltripropoxysilane
(1-19): Phennyltrimethoxysilane
(1-20): Phencyltriethoxysilane
(1-21): Phenyltripropoxysilane
(1-22): Diphenyldimethoxysilane
(1-23): Diphenyldiethoxysilane In the case when the hydrolyzable silane compound having the structure represented by the formula (1) is used, the a in the formula (1) may preferably be an integer of 1 or more to 3 or less, and the b may preferably be an integer of 1 or more to 3 or less. Further, one $R^{11}$ of a-number of $R^{11}$'s may preferably be a straight-chain alkyl group having 1 or more to 21 or less carbon atoms.

Only one of the hydrolyzable silane compound having the structure represented by the formula (1) may be used, or two or more thereof may be used. In the case when two or more thereof are used, one in which the $R^{11}$ in the formula (1) is an alkyl group(s) and one in which the $R^{11}$ in the formula (1) is a phenyl group(s) may preferably be used in combination. The alkyl group is preferable from the viewpoints of controlling surface properties of the charging member and readiness for the compound to segregate to the outermost surface, in particular, making small the value of $\gamma^p+\gamma^h$ described later. However, a case in which a potential difference is produced between saturated potentials of the charging first round and charging second and subsequent rounds (dark potentials $V_{D1}$ and $V_{D2}$) may have an influence on images. When halftone images are continuously reproduced immediately after characters or black figures have been formed as electrostatic latent images, such an influence on images may appear as a phenomenon that the characters or black figures previously formed remain slightly as afterimages (ghost images) on the halftone images. Though the reason is unclear, the phenyl group is preferred from the viewpoint of preventing the phenomenon of ghost, intending to make the above potential difference small.

A specific process for producing the charging member of the present invention (how to specifically form the surface layer containing the polysiloxane) is described below.

First, the hydrolyzable silane compound having a cationic-polymerizable group and optionally the above additional hydrolyzable silane compound are subjected to hydrolysis reaction in the presence of water to obtain a hydrolytic condensation product.

In the hydrolysis reaction, a hydrolytic condensation product having the desired degree of condensation is obtainable by controlling temperature, pH and so forth.

In the hydrolysis reaction, the degree of condensation may also be controlled by utilizing a metal alkoxide or the like as a catalyst for the hydrolysis reaction. The metal alkoxide may include, e.g., aluminum alkoxides, titanium alkoxides and zirconium alkoxides, and also complexes (such as acetyl acetone complexes) of any of these.

In obtaining the hydrolytic condensation product, the hydrolyzable silane compound having a cationic-polymerizable group and the hydrolyzable silane compound having the structure represented by the formula (1) may preferably be so mixed as to be in the following proportion: The acrylic group in the polysiloxane obtained is in a content of from 1.0% by mass or more to 20.0% by mass or less based on the total mass of the polysiloxane, the oxyalkylene group is in a content of from 4.0% by mass or more to 70.0% by mass or less based on the total mass of the polysiloxane, and the siloxane moiety is in a content of from 20.0% by mass or more to 95.0% by mass or less based on the total mass of the polysiloxane.

In the case when the hydrolyzable silane compound having the structure represented by the formula (1) is used in combination, the hydrolyzable silane compound having a cationic-polymerizable group (Mc) and the hydrolyzable silane compound having the structure represented by the formula (1) ($M_1$) may further preferably be so mixed as to be in a molar ratio ($Mc:M_1$) ranging from 10:1 to 1:10.

Next, to the hydrolytic condensation product thus obtained, a compound is added which is a block copolymer synthesized from an acrylic monomer and a silicon monomer to prepare a surface layer coating solution first. Then, a member having the support and the conductive elastic layer formed on the support (the member is hereinafter also "conductive elastic member") is coated with the surface layer coating solution thus prepared.

The step of adding the block copolymer is provided separately from the step of condensing the silane compound by hydrolysis, in order to make the block copolymer of an acrylic monomer and a silicon monomer segregate to the outermost surface with ease. The reason therefor is that it has been found that, if it is added during synthesis, the effect of making the copolymer segregate may come so small as to result in a very small effect against the adhesion of the toners and external additives.

The block copolymer synthesized from an acrylic monomer and a silicon monomer may further preferably be an A-B type diblock copolymer.

A graft type one is also present in the block copolymer synthesized from an acrylic monomer and a silicon monomer, but is less effective on the effect of segregation to the outermost surface. This is presumed due to the manner of its mutual action with the polysiloxane, where especially the graft type one tends to come into a polymer micelle (the moiety derived from the acrylic monomer is on the polysiloxane side, and the moiety derived from the silicon monomer is on the inner side), and hence it comes structurally incorporated in the interior of the polysiloxane.

Here, the acrylic monomer may include compounds represented by the following formula (3).

(3)

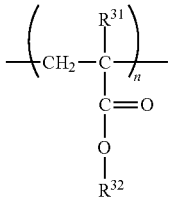

In the formula (3), $R^{31}$ represents a hydrogen atom or a methyl group. $R^{32}$ represents a straight-chain or branched-chain alkylene group having 1 or more to 20 or less carbon atoms, or an alicyclic hydrocarbon group having 6 or more to 12 or less carbon atoms. Letter symbol n is an integer of 10 to 1,000.

Stated more specifically, the acrylic monomer may include the following: Carboxylic acid-containing vinyl monomers such as (meth)acrylic acid ["(meth)acrylic acid" is generically termed to include "methacrylic acid" and "acrylic acid"; the same applies hereinafter], itaconic acid, crotonic acid, maleic acid and fumaric acid; hydroxyl group-containing vinyl monomers such as 2-hydroxyethyl(meth)acrylate, 2-hydroxypropyl(meth)acrylate and allyl alcohol; (meth) acrylic esters such as methyl(meth)acrylate, ethyl(meth)acrylate, n-propyl(meth)acrylate, isopropyl(meth)acrylate, glycidyl(meth)acrylate, n-butyl(meth)acrylate, isobutyl(meth) acrylate, tert-butyl(meth)acrylate, 2-ethylhexyl(meth) acrylate, octyl(meth)acrylate, lauryl(meth)acrylate, stearyl (meth)acrylate, cyclohexyl(meth)acrylate and benzyl(meth) acrylate; amide group-containing vinyl monomers such as (meth)acrylamide, N-methylol(meth)acrylamide, N,N-dimethyl(meth)acrylamide, N-(meth)acryloyl morpholine; esters of polyethylene glycol or polypropylene glycol of (meth) acrylic acid, such as triethylene glycol(meth)acrylate and dipolypropylene glycol(meth)acrylate; aromatic vinyl monomers such as styrene, vinyltoluene and α-methylstyrene; carboxylic acid vinyl esters such as vinyl formate, vinyl acetate, vinyl propionate and vinyl stearate; (meth)acrylic esters of alcohols having a tertiary amino group, such as N,N-dimethylamino(meth)acrylate; and quaternary ammonium salts derived from (meth)acrylic acid, such as 2-hydroxy-3-methacryloxypropyl methylammonium chloride.

The acrylic monomer may also be so polymerized as to be used in the form of a copolymer which may include acrylic-methacrylic copolymers, and copolymers of i) polymers having an azo linkage or a peroxy linkage and ii) methyl acrylate, such as a compound having a structure represented by the following formula (4) and a compound having a structure represented by the following formula (5).

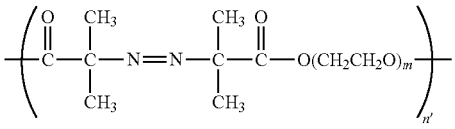

(4)

In the formula (4), m and n' are each an integer of 1 or more to 10 or less.

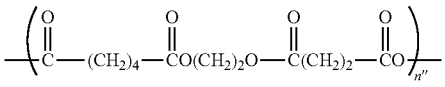

(5)

In the formula (5), n" is an integer of 1 or more to 10 or less.

The silicon monomer may include $(CH_3)_3SiCl$, $(CH_3)_2SiCl_2$, $(CH_3)SiCl_3$, $(CH_3)HSiCl_2$, $(C_6H_5)_2SiCl_2$, $C_6H_5Si(CH_3)Cl_2$, $(C_6H_5)_2SiCl_3$ and $(CH_3)(CH_2{=}CH)SiCl_2$.

There are no particular limitations on the mass ratio of the acrylic monomer and silicon monomer. It may preferably be in the range of from 5/95 to 95/5 as acrylic monomer/silicon monomer, and more preferably in the range of from 20/80 to 80/20. If the silicon monomer is in a too small ratio, no sufficient toner adhesion may be achievable. If the acrylic monomer is in a too small ratio, its compatibility with the polysiloxane moiety may come poor (microscopic phase separation), and hence the layer itself may have a large non-uniformity to achieve no sufficient durability (running performance).

The block copolymer synthesized from the above acrylic monomer and silicon monomer may include, e.g., MODIPER FS Series, available from Nippon Oil & Fats Co., Ltd.

The block copolymer synthesized from the above acrylic monomer and silicon monomer may preferably be added in an amount of from 1% by mass or more to 20% by mass or less, and, in particular, more preferably from 2% by mass or more to 10% by mass or less, based on the hydrolytic condensation product obtained. If it is added in too small amount, no sufficient low adhesion of the toners and external additives may be achievable. If it is added in too large amount, it may have a poor compatibility or may result in a high cost.

In preparing the surface layer coating solution, besides the hydrolytic condensation product, a suitable solvent may be used in order to improve coating performance. Such a suitable solvent may include, e.g., alcohols such as ethanol and 2-butanol, ethyl acetate, and methyl ethyl ketone, or a mixture of any of these. Also, coating making use of a roll coater, dip coating, ring coating or the like may be employed in coating the surface layer coating solution on the conductive elastic member.

Next, the surface layer coating solution coated on the conductive elastic member is irradiated with active energy radiation, whereupon cationic-polymerizable groups in the hydrolytic condensation product contained in the surface layer coating solution are cleaved. Thus, the hydrolytic condensation product can thereby be cross-linked. The hydrolytic condensation product come cured by cross-linking.

As the active energy radiation, ultraviolet radiation is preferred.

Because of the heat generated at the time of the irradiation with active energy radiation, the conductive elastic layer of the conductive elastic member expands, and it contracts thereafter as a result of cooling. In that course, if the surface layer does not well follow up this expansion and contraction, the surface layer may come to have many wrinkles or cracks. However, where the ultraviolet radiation is used in the cross-linking reaction, the hydrolytic condensation product can be cross-linked in a short time (within 15 minutes) and moreover the heat is less generated. Hence, the surface layer can not easily be wrinkled or cracked.

Where the environment in which the charging member is placed is an environment causative of abrupt changes in temperature and humidity, the surface layer may also be wrinkled or cracked if the surface layer does not well follow up the expansion and contraction of the conductive elastic layer because of such changes in temperature and humidity. However, as long as the cross-linking reaction is carried out using the ultraviolet radiation, which less generates heat, the adherence between the conductive elastic layer and the surface layer is improved to enable the surface layer to well follow up the expansion and contraction of the conductive elastic layer. Hence, the surface layer can also be kept from being wrinkled or cracked because of the changes in temperature and humidity.

In addition, as long as the cross-linking reaction is carried out using the ultraviolet radiation, the conductive elastic layer can be kept from deterioration due to heat history, and hence the conductive elastic layer can also be kept from a lowering of its electrical properties.

In the irradiation with ultraviolet radiation, usable are a high-pressure mercury lamp, a metal halide lamp, a low-pressure mercury lamp, an excimer UV lamp and the like. Of these, an ultraviolet radiation source may be used which is rich in light of from 150 nm or more to 480 nm or less in wavelength as ultraviolet radiation.

The ultraviolet radiation has the integral light quantity that is defined as shown below.

Ultraviolet radiation integral light quantity(mJ/cm$^2$)= ultraviolet radiation intensity(mW/cm$^2$)×irradiation time(s).

The integral light quantity of the ultraviolet radiation may be controlled by selecting irradiation time, lamp output, distance between the lamp and the irradiation object, and so forth. The integral light quantity may also be sloped within the irradiation time.

Where the low-pressure mercury lamp is used, the integral light quantity of the ultraviolet radiation may be measured with an ultraviolet radiation integral light quantity meter UIT-150-A or UVD-S254, manufactured by Ushio Inc. Where the excimer UV lamp is used, the integral light quantity of the ultraviolet radiation may be measured with an ultraviolet radiation integral light quantity meter UIT-150-A or VUV-S172, manufactured by Ushio Inc.

In carrying out the cross-linking reaction, from the viewpoint of improving cross-linking efficiency, a cationic polymerization catalyst (polymerization initiator) may also be kept present together. For example, the epoxy group shows a high reactivity on an onium salt of Lewis acid activated by the active energy radiation. Accordingly, where the above cationic-polymerizable group is the epoxy group, the onium salt of Lewis acid may preferably be used as the cationic polymerization catalyst.

Other cationic polymerization catalyst may include, e.g., borates, compounds having an imide structure, compounds having a triazine structure, azo compounds, and peroxides.

Of such cationic polymerization catalysts, aromatic sulfonium salts and aromatic iodonium salts are preferred from the viewpoint of sensitivity, stability and reactivity. In particular, preferred are a bis(4-tert-butylphenyl) iodonium salt, a compound having a structure represented by the following formula (trade name: ADEKA OPTOMER SP150, available from Asahi Denka Kogyo K.K.):

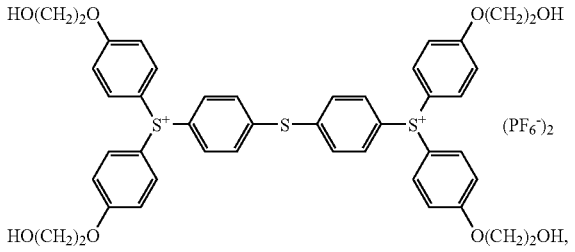

a compound having a structure represented by the following formula (trade name: IRGACURE 261, available from Ciba Specialty Chemicals Inc.):

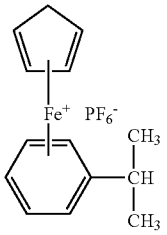

Total surface free energy ($\gamma^{Total}$) of the charging member is described below.

The charging member of the present invention may preferably have a total surface free energy ($\gamma^{Total}$) of from more than 15 mJ/m to 30 mJ/m$^2$ or less. Of $\gamma^{Total}=\gamma^d+\gamma^p+\gamma^h$, especially $\gamma^p+\gamma^h$ (the sum of polar term+hydrogen bond term parts may preferably be $0<\gamma^p+\gamma^h<5$, and particularly preferably be $0<\gamma^p+\gamma^h<3$.

The smaller the $\gamma^{Total}$ is and the smaller the value of $\gamma^p+\gamma^h$ is, the toners and external additives show a tendency not to more easily cling to the surface of the charging member.

The total surface free energy of the charging member is measured by using a probe liquid having the known surface energy three components shown in Table 1.

$\gamma^d$: Dispersion force term.

$\gamma^p$: Polar term.

$\gamma^h$: Hydrogen bond term.

TABLE 1

| Probe liquid | Kitazaki-Hata Theory | | | |
|---|---|---|---|---|
| | $\gamma L^d$ | $\gamma L^p$ | $\gamma L^h$ | $\gamma L^{Total}$ |
| Water | 29.1 | 1.3 | 42.4 | 72.8 |
| Diiodomethane | 46.8 | 4.0 | 0.0 | 50.8 |
| Ethylene glycol | 30.1 | 0.0 | 17.6 | 47.7 |

Unit: mJ/m$^2$

Stated specifically, a contact angle meter CA-X ROLL Model, manufactured by Kyowa Interface Science Co., Ltd., is used to measure contact angles θ of the above respective probe liquids at the surface of the surface layer or conductive elastic layer. Then, using the following Kitazaki-Hata theory expression:

$$\sqrt{\gamma L^d \times \gamma S^d} + \sqrt{\gamma L^p \times \gamma S^p} + \sqrt{\gamma L^h \times \gamma S^h} - \frac{\gamma L(1+\cos\theta)}{2},$$

three expressions are prepared from the three sorts of surface free energies $\gamma L^d$, $\gamma L^p$ and $\gamma L^h$ of the probe liquids in Table 1 and the contact angles θ found respectively. The resultant simultaneous equation with three unknowns is solved to find $\gamma S^d$, $\gamma S^p$ and $\gamma S^h$. The sum of $\gamma S^d$, $\gamma^p$ and $\gamma S^h$ is regarded as the total surface free energy ($\gamma^{Total}$) of the charging member.

Detailed measuring conditions of the contact angle θ are as follows:

Measurement: Droplet method (true-circle fitting).
Quantity of liquid: 1 μl.
Droplet impact recognition: Automatic.
Image processing: Algorithm-nonreflection.
Image mode: Frame.
Threshold level: Automatic.

In the present invention, the surface layer of the charging member may preferably have a volume resistivity of from $10^{10}$ Ω·cm or more to $10^{16}$ Ω·cm or less. If it has a too small volume resistivity, the electrical properties of the surface layer which are necessary for the formation of good images may come insufficient when used repeatedly. If on the other hand it has a too large volume resistivity, the time taken to effect discharge (microscopic discharge in the vicinity of contact zone between the electrophotographic photosensitive member and the charging member) may be too long to sufficiently charge the electrophotographic photosensitive member when images are reproduced at a high speed.

In the present invention, the volume resistivity of the surface layer refers to the value found by measurement made in the following way.

That is, using a spin coater, an aluminum sheet (thickness: 100 μm) is coated with the surface layer coating solution used when the surface layer of the measuring object charging member is formed. The wet coating formed is cured and dried under the same conditions as those set when the surface layer of the measuring object charging member is formed, to form a layer on the aluminum sheet. Here, the coating weight in coating the aluminum sheet with the surface layer coating solution is so controlled that the layer formed (the layer formed after curing and drying) on the aluminum sheet may have a layer thickness of 10 μm.

The aluminum sheet on which the layer has been thus formed is cut in a square shape (4 cm×4 cm), and then gold is vacuum-deposited on the surface on the layer side of the sample piece.

The sample piece thus vacuum-deposited with gold is set in a resistance measuring system constructed as shown in FIG.

Figure 2:
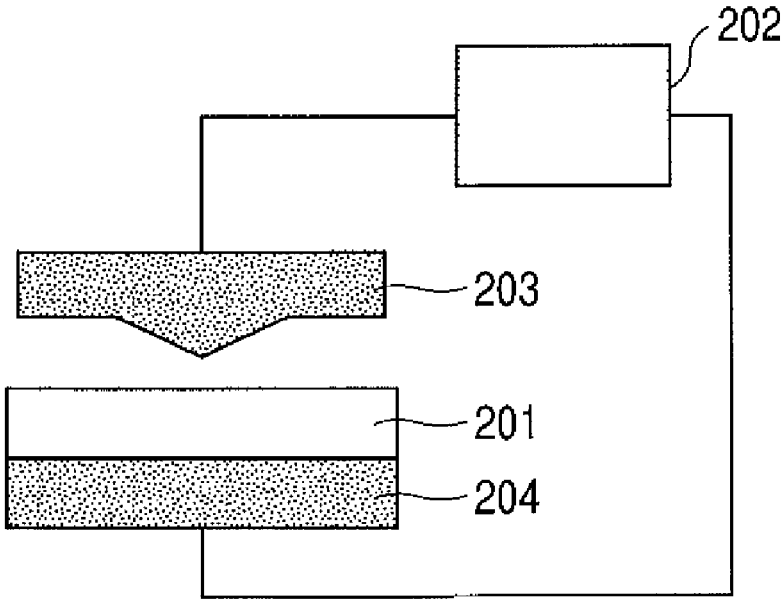
FIG. 2 schematically illustrates a measuring machine for the volume resistivity of surface layers.

2. Its resistance is measured under conditions of an accelerating direct-current voltage of 10 V. The resistance found by the measurement is converted into the volume resistivity from sample area and thickness, which is regarded as the volume resistivity of the surface layer of the measuring object charging member. In FIG. 2, the system has a sample piece 201, a resistance measuring unit 202 (4140B PA METER/DC voltage source, manufactured by Hewlett-Packard Co.), a contact electrode terminal 203 and a flat-plate electrode 204.

Figure 3:
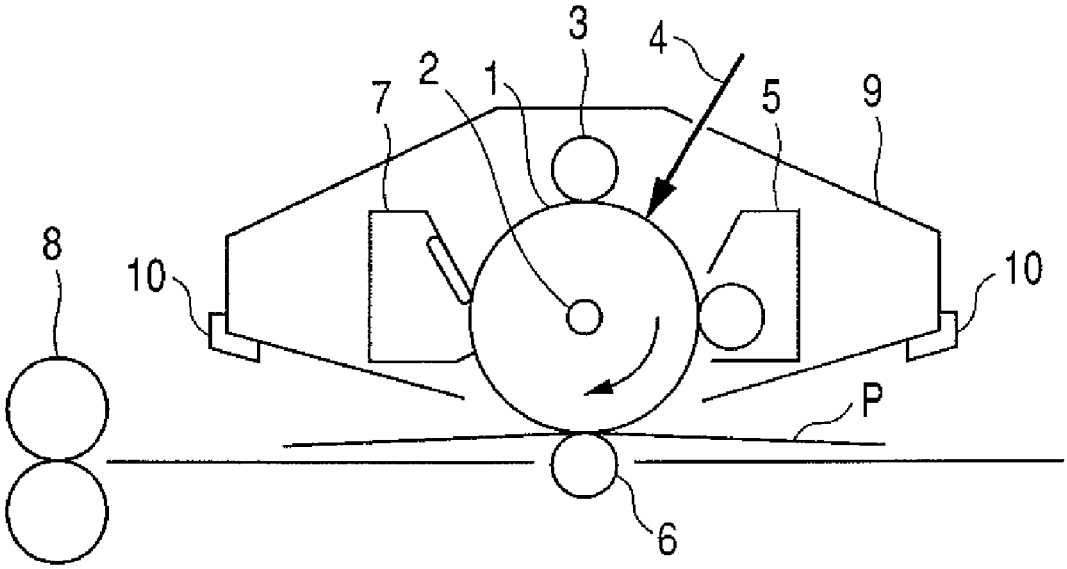
FIG. 3 schematically illustrates an example of the construction of an electrophotographic apparatus provided with a process cartridge having the charging member of the present invention.

The construction of an example of an electrophotographic apparatus provided with a process cartridge having an electrophotographic photosensitive member and the charging member of the present invention is schematically shown in FIG. 3.

In what is shown in FIG. 3, a cylindrical electrophotographic photosensitive member 1 is rotatingly driven around an axis 2 in the direction of an arrow at a stated peripheral speed. As the electrophotographic photosensitive member, what is common is one having a support and an inorganic photosensitive layer or organic photosensitive layer formed on the support. The electrophotographic photosensitive member may also be one having a charge injection layer as a surface layer.

The surface of the electrophotographic photosensitive member 1 being rotatingly driven is uniformly electrostatically charged to a positive or negative, given potential through a charging member 3 (in FIG. 3, a roller-shaped charging member) which is the charging member of the present invention. The electrophotographic photosensitive member thus charged is then exposed to exposure light (imagewise exposure light) 4 emitted from an exposure unit (not shown) for slit exposure or laser beam scanning exposure. In this way, electrostatic latent images corresponding to the intended image are successively formed on the surface of the electrophotographic photosensitive member 1.

In charging the surface of the electrophotographic photosensitive member by means of the charging member 3, a voltage of direct-current voltage only or a voltage formed by superimposing an alternating-current voltage on a direct-current voltage is applied to the charging member 3 from a voltage applying unit (not shown). In Examples given later, a voltage of direct-current voltage only (−1,000 V) is applied. Also, in Examples given later, dark-area potential is set at −500 V, and light-area potential at −120 V.

The electrostatic latent images thus formed on the surface of the electrophotographic photosensitive member 1 are developed (reversal development or regular development) with a toner contained in a developer in a developing unit 5 to come into toner images. The toner images thus formed and held on the surface of the electrophotographic photosensitive member 1 are then successively transferred by the aid of a transfer bias given from a transfer unit (such as a transfer roller) 6; being transferred to a transfer material (such as paper) P fed from a transfer material feed unit (not shown) to the part (contact zone) between the electrophotographic photosensitive member 1 and the transfer unit 6 in the manner synchronized with the rotation of the electrophotographic photosensitive member 1.

The developing unit may include, e.g., a jumping developing unit, a contact developing unit and a magnetic-brush developing unit. The contact developing unit is preferred from the viewpoint of better keeping the toner from scattering. In Examples given later, the contact developing unit is employed.

As the transfer roller, it may be exemplified by one having a support which is covered thereon with an elastic resin layer controlled to have a medium resistance.

The transfer material P to which the toner images have been transferred is separated from the surface of the electrophotographic photosensitive member 1, is guided into a fixing unit 8, where the toner images are fixed, and is then put out of the apparatus as an image-formed material (a print or a copy). In the case of a double-side image formation mode or a multiple image formation mode, this image-formed material is guided into a re-circulation transport mechanism (not shown), and then again guided to the transfer section.

The surface of the electrophotographic photosensitive member 1 from which the toner images have been transferred is brought to removal of the developer (toner) remaining after the transfer, through a cleaning unit (such as a cleaning blade) 7. Thus the electrophotographic photosensitive member is cleaned on its surface. It is further subjected to charge elimination by pre-exposure light (not shown) emitted from a pre-exposure unit (not shown), and thereafter repeatedly used for the formation of images. Incidentally, where the charging unit is a contact charging unit, the pre-exposure is not necessarily required.

The apparatus may be constituted of a combination of plural components held in a container and integrally joined as a process cartridge from among the constituents such as the above electrophotographic photosensitive member 1, charging member 3, developing unit 5, transfer unit 6 and cleaning unit 7 so that the process cartridge is detachably mountable to the main body of the electrophotographic apparatus such as a copying machine or a laser beam printer. In what is shown in FIG. 3, the electrophotographic photosensitive member 1, the primary charging unit 3, the developing unit 5 and the cleaning unit 7 are integrally supported in the cartridge to form a process cartridge 9 that is detachably mountable to the main body of the apparatus through a guide unit 10 such as rails provided in the main body of the electrophotographic apparatus.

EXAMPLES

The present invention is described below in greater detail by giving specific working examples. Note, however, that the present invention is by no means limited to these examples. In Examples, "part(s)" refers to "part(s) by mass".

Example 1

100 parts of epichlorohydrin rubber (trade name: EPICHLOMER CG105, available from Daiso Co., Ltd.), 35 parts of MT carbon (trade name: N990; available from Thermax Co.) as a filler, and as conducting agents 14 parts of HAF (trade name: SEAST 3, available from Tokai Carbon Co., Ltd.), 4 parts of conductive carbon (trade name: KETJEN BLACK EC600JD, available from Lion Corporation), 5 parts of zinc oxide and 1 part of stearic acid were kneaded for 24 minutes by means of a 6 L kneader. To the kneaded product obtained, 1 part of di-2-benzothiazolyl disulfide (trade name: NOCCELER DM-P, available from Ouchi-Shinko Chemical Industrial Co., Ltd.) as a vulcanization accelerator, 0.5 part of tetraethylthiuram monosulfide (trade name: NOCCELER TS, available from Ouchi-Shinko Chemical Industrial Co., Ltd.) as a vulcanization accelerator and 1.2 parts of sulfur as a vulcanizing agent were added, and these were kneaded for further 10 minutes by means of an open roll to obtain a kneaded product I.

Next, the kneaded product I was extruded by means of a rubber extruder into a cylindrical form of 9.5 mm in outer diameter and 5.4 mm in inner diameter. This was cut in a length of 250 mm, and then primarily vulcanized in a vulcanizer for 30 minutes using 160° C. water vapor to obtain a primary-vulcanized tube for conductive elastic layer.

Meanwhile, a support made of steel (one having been surface-plated with nickel) in a columnar shape of 6 mm in diameter and 256 mm in length was coated with an adhesive in the areas up to 115.5 mm from the both ends interposing the middle of the column surface in the axial direction (the areas of 231 mm in total in width in the axial direction); the adhesive being a metal- and rubber-containing thermosetting adhesive (trade name: METALOCK U-20, available from Toyokagaku Kenkyusho Co., Ltd.). The wet coating thus formed was dried at 80° C. for 30 minutes, and thereafter further dried at 120° C. for 1 hour.

This support coated on its columnar surface with the thermosetting adhesive was inserted into the primary-vulcanized tube for conductive elastic layer, and thereafter the primary-vulcanized tube for conductive elastic layer was heated at 160° C. for 1 hour. Upon this heating, the primary-vulcanized tube for conductive elastic layer was secondarily vulcanized, and also the thermosetting adhesive was cured. Thus, a conductive elastic roller 1 before surface grinding was obtained.

Next, the conductive elastic roller 1 before surface grinding was cut at is both ends of the conductive elastic layer portion (rubber portion) to make the conductive elastic layer portion have a width of 231 mm in the axial direction. Thereafter, the surface of the conductive elastic layer portion was ground with a rotary grinding wheel. As the result, a conductive elastic roller 2 (conductive elastic roller after surface grinding) was obtained which had a crown shape of 8.26 mm in diameter at end portions and 8.5 mm in diameter at the middle portion, having a surface ten-point average roughness (Rz) of 3.5 μm and having a run-out of 20 μm.

The ten-point average roughness (Rz) was measured according to JIS B 6101.

The run-out was measured with a high-precision laser measuring instrument LSM-430V, manufactured by Mitutoyo Corporation. Stated in detail, the outer diameter was measured with the measuring instrument, and the difference between a maximum outer diameter value and a minimum outer diameter value was regarded as outer diameter difference run-out. This measurement was made at five spots, and an average value of outer diameter difference run-out at five spots was regarded as the run-out of the measuring object.

The conductive elastic roller (conductive elastic roller after surface grinding) 2 thus obtained had a hardness of 71 degrees (Asker-C hardness). Here, in the present invention, the Asker-C hardness is measured under conditions of a load of 1,000 g, bringing a loaded needle of an Asker-C hardness meter (manufactured by Koubunshi Keiki Co., Ltd.) into touch with the surface of the measuring object.

Next, to obtain a treating agent for the surface layer, 35.64 g (0.128 mol) of glycidoxypropyltriethoxysilane (GPTES) (trade name: KBE-403, available from Shin-Etsu Chemical Co., Ltd.), 30.77 g (0.128 mol) of phenyltriethoxysilane (PhTES) (trade name: KBE-103, available from Shin-Etsu Chemical Co., Ltd.) and 13.21 g (0.064 mol) of hexyltrimethoxysilane (HeTMS) (trade name: KBM-3063, available from Shin-Etsu Chemical Co., Ltd.) as hydrolyzable silane compounds and also 25.93 g of water and 63.07 g of ethanol were mixed in a 300 ml egg-plant type flask. The mixture thus obtained was stirred at room temperature for 30 minutes, and then heat-refluxed for 24 hours on an oil bath set at 120° C., to obtain a condensation product I (solid content: 28% by mass) of the hydrolyzable silane compound.

25 g of this condensation product I was added to a mixed solvent of 5 g of 2-butanol and 65 g of ethanol. To the solution obtained, 5 g of an A-B type block copolymer 1 [trade name: MODIPER FS-710 (solid content: 15% by mass; available from Nippon Oil & Fats Co., Ltd.)] synthesized from an acrylic monomer and a silicon monomer was further added to prepare a condensation product-containing alcohol solution having a solid content of 7% by mass.

To 100 g of this condensation product-containing alcohol solution, 2 g of an aromatic sulfonium salt (trade name: ADEKA OPTOMER SP-150, available from Asahi Denka Kogyo K.K.) as a cationic photopolymerization initiator, having been diluted with methyl isobutyl ketone (MIBK) to 10%, was added to prepare a surface layer coating solution 1.

Next, the conductive elastic roller (conductive elastic roller after surface grinding) 2 was coated on its conductive elastic layer with the surface layer coating solution 1, having been further adjusted to have a solid content of 0.5% by mass by ethanol, by ring coating. This was irradiated with ultraviolet radiation of 254 nm in wavelength so as to be in an integral light quantity of 9,000 mJ/cm$^2$ to cause the surface layer coating solution 1 to cure (curing by cross-linking reaction) and then allowed to dry to form a surface layer. A low-pressure mercury lamp manufactured by Harison Toshiba Lighting Corp. was used in the irradiation with ultraviolet radiation.

It is considered that the irradiation with ultraviolet radiation has caused cleavage of glycidoxy groups of the glycidoxypropyltrimethoxysilane to cause the cross-linking reaction of the condensation product 1.

The surface layer formed by curing the surface layer coating solution 1 had a volume resistivity of $1.3\times10^{12}$ Ω·cm.

A charging roller was thus produced, which was designated as a charging roller I.

The charging roller I thus produced had a total surface free energy ($\gamma^{Total}$) of 22.1 mJ/m$^2$. Here, the value of $\gamma^p+\gamma^h$ was 1.2 mJ/m$^2$.

Evaluation of Charging Roller:

An electrophotographic photosensitive member to be incorporated in a process cartridge together with the charging roller I is an organic electrophotographic photosensitive member having a support and formed thereon an organic photosensitive layer of 14 μm in layer thickness. This organic photosensitive layer is a multi-layer type photosensitive layer having a charge generation layer and a charge transport layer containing a modified polycarbonate (binder resin) which are superposed in this order from the support side. This charge transport layer stands the surface layer of the electrophotographic photosensitive member.

Using a charging roller I produced in the same manner as the above, images reproduced were evaluated as shown below.

The charging roller I thus produced and the electrophotographic photosensitive member were incorporated in the process cartridge in which these are to be integrally supported. This process cartridge was mounted to a laser beam printer for A4-paper lengthwise paper feed. The development system of this laser beam printer (HP Color Laser Jet 3600) is the reversal development system, where transfer material feed speed is 94 mm/s, and image resolution is 600 dpi.

The electrophotographic photosensitive member set in the process cartridge together with the charging roller I is the same as the above.

A toner used in the laser beam printer is what is called a polymerization toner having toner particles which are particles obtained by suspension-polymerizing in an aqueous medium a polymerizable monomer system-containing a wax, a charge control agent, a colorant, styrene, butyl acrylate and ester monomers and to which particles fine silica particles and fine titanium oxide particles have externally been added. Its glass transition temperature is 63° C. and volume-average particle diameter is 6 μm.

Images were reproduced in an environment of 30° C./80% RH. Halftone images (images in which horizontal lines with a line width of one dot each and at spaces of 2 dots were drawn in the direction perpendicular to the rotational direction of the electrophotographic photosensitive member) were formed on A4-size paper, and this was reproduced on 3,000 sheets at a process speed of 94 mm/s.

To evaluate images reproduced, the images reproduced were visually observed at intervals of 1,000 sheets.

Evaluation criteria are as shown below.

AA: Any charging non-uniformity due to toners and external additives which may cling to the surface of the charging roller is not seen on the images reproduced.

A: Charging non-uniformity due to toners and external additives which may cling to the surface of the charging roller is little seen on the images reproduced.

B: Charging non-uniformity due to toners and external additives having clung to the surface of the charging roller is seen on the images reproduced.

C: Charging non-uniformity due to toners and external additives having clung to the surface of the charging roller is seen on the images reproduced, and such charging non-uniformity comes about in a great extent. Stated specifically, charging non-uniformity in white vertical lines is seen.

Results of the above evaluation are shown in Table 3.

Compositional analysis of the surface layer of the charging roller I was also made in the following way.

Under an optical microscope of 10 to 1,000 magnifications, about 1 mg of a sample was collected from the surface layer of a charging roller V produced in the same manner as the above, using a three-dimensional rough-slight movement micromanipulator (manufactured by K.K. Narishige) set in the optical microscope.

The sample collected was examined by the TG-MS (thermogravimetry-mass spectrometry) method (an MS device is directly combined with a TG device), and changes in concentration per mass number of the gas generated at the time of heating were traced as the function of temperature, simultaneously with changes in weight. Conditions for the measurement are shown in Table 2.

TABLE 2

| |
|---|
| Instrument: |
| TG device: TG-40 Model, manufactured by Shimadzu Corporation<br>MS device: GC/MS QP1000(1), manufactured by Shimadzu Corporation<br>Measurement conditions: |
| Start of measurement: The sample is set in the TG device, and thereafter, after carrier gas is flowed for 15 minutes or more, heating is started.<br>Heating conditions: From room temperature to 1,000° C. (heating rate: 20° C./min).<br>MS sensitivity: |
| Gain 3.5<br>Range of mass number: |
| m/z = 10 to 300.<br>The m of m/z represents the mass number; and z, the valence of ions.<br>Usually, the valence of ions is 1 and hence m/z corresponds to the mass number.<br>Atmosphere: |
| Helium (He) flow (30 ml/min). |

According to the TG-DTG (derivative thermogravimetry) curve obtained by the measurement made under the above conditions, weight loss was seen in the vicinity of room temperature, and two-stage remarkable weight loss was also seen in the vicinity of 400° C. to 500° C. and in the vicinity of 500° C. to 600° C.

Here, in respect of the gas generated at 400° C. to 600° C., oxyalkylene groups (due to glycidoxy groups of glycidoxypropyltriethoxysilane) of 29, 31, 43, 58 and 59 in mass number (m/z) were ascertainable. Further, from their weight loss percentage, the content of oxyalkylene groups in the polysiloxane was found to be 17.10% by mass based on the total mass of the polysiloxane.

As to the content of alkyl groups in the polysiloxane, alkyl groups of 41, 55, 69 and so forth in mass number (m/z) were ascertainable. From their weight loss percentage, their content was found to be 7.89% by mass based on the total mass of the polysiloxane. As to the content of phenyl groups in the polysiloxane, phenyl groups of 43, 44 and 78 (benzene) in mass number (m/z) and 91 (toluene) in mass number (m/z) were ascertainable. From their weight loss percentage, their content was found to be 12.88% by mass based on the total mass of the polysiloxane. Those due to acrylic groups of 87,100 in mass number (m/z) were also ascertainable. From their weight loss percentage, the content of acrylic groups in the polysiloxane was found to be 3.61% by mass based on the total mass of the polysiloxane.

Residues are considered to be siloxane moieties in the polysiloxane, and hence the content of siloxane moieties in the polysiloxane is 100.00−(17.10+12.88+7.89+3.61)=58.52% by mass based on the total mass of the polysiloxane.

Example 2

In regard to the conductive elastic layer, the one used in Example 1 was used.

Next, as a treating agent for the surface layer, the condensation product I of the hydrolyzable silane compound as used in Example 1 was used, and 25 g of this condensation product I was added to a mixed solvent of 5 g of 2-butanol and 65 g of ethanol. To the solution obtained, 5 g of an A-B type block copolymer 2 [trade name: MODIPER FS-720 (solid content: 15% by mass; available from Nippon Oil & Fats Co., Ltd.)] synthesized from an acrylic monomer and a silicon monomer was further added to prepare a condensation product-containing alcohol solution having a solid content of 7% by mass. Then, a cationic photopolymerization initiator was added in the same way as in Example 1 to obtain a surface layer coating solution 2.

As to the subsequent formation of the surface layer, it was formed in the same way as in Example 1 to produce a charging roller II.

The surface layer formed by curing the surface layer coating solution 2 had a volume resistivity of $4.3\times10^{12}$ Ω·cm.

The charging roller II produced had a total surface free energy ($\gamma^{Total}$) of 21.3 mJ/m$^2$. Here, the value of $\gamma^p+\gamma^h$ was 0.5 mJ/m$^2$.

Compositional analysis of the surface layer of the charging roller II was also made in the same way as the compositional analysis of the surface layer of the charging roller I in Example 1. As the result, the content of oxyalkylene groups in the polysiloxane was found to be 15.98% by mass based on the total mass of the polysiloxane. The content of alkyl groups in the polysiloxane was found to be 9.06% by mass based on the total mass of the polysiloxane. The content of phenyl groups in the polysiloxane was found to be 12.86% by mass based on the total mass of the polysiloxane. The content of acrylic groups in the polysiloxane was found to be 4.34% by mass based on the total mass of the polysiloxane. Residues are considered to be siloxane moieties in the polysiloxane, and hence the content of siloxane moieties in the polysiloxane is 100.00−(15.98+9.06+12.86+4.34)=57.76% by mass based on the total mass of the polysiloxane.

Images were reproduced and evaluated in the same way as in Example 1. Results obtained are shown in Table 3.

Example 3

In regard to the conductive elastic layer, the one used in Example 1 was used.

Next, as a treating agent for the surface layer, the condensation product I of the hydrolyzable silane compound as used in Example 1 was used, and 25 g of this condensation product I was added to a mixed solvent of 7.5 g of 2-butanol and 65 g of ethanol. To the solution obtained, 2.5 g of an A-B type block copolymer 3 [trade name: MODIPER FS-730 (solid content: 30% by mass; available from Nippon Oil & Fats Co., Ltd.)] synthesized from an acrylic monomer and a silicon monomer was further added to prepare a condensation product-containing alcohol solution having a solid content of 7% by mass. Then, a cationic photopolymerization initiator was added in the same way as in Example 1 to obtain a surface layer coating solution 3.

As to the subsequent formation of the surface layer, it was formed in the same way as in Example 1 to produce a charging roller III.

The surface layer formed by curing the surface layer coating solution 3 had a volume resistivity of $6.8\times10^{12}$ Ω·cm.

The charging roller III produced had a total surface free energy ($\gamma^{Total}$) of 22.5 mJ/m$^2$. Here, the value of $\gamma^p+\gamma^h$ was 0.3 mJ/m$^2$.

Compositional analysis of the surface layer of the charging roller III was also made in the same way as the compositional analysis of the surface layer of the charging roller I in Example 1. As the result, the content of oxyalkylene groups in the polysiloxane was found to be 16.60% by mass based on the total mass of the polysiloxane. The content of alkyl groups in the polysiloxane was found to be 8.11% by mass based on the total mass of the polysiloxane. The content of phenyl groups in the polysiloxane was found to be 14.69% by mass based on the total mass of the polysiloxane. The content of acrylic groups in the polysiloxane was found to be 4.06% by mass based on the total mass of the polysiloxane. Residues are considered to be siloxane moieties in the polysiloxane, and hence the content of siloxane moieties in the polysiloxane is 100.00−(16.60+8.11+14.69+4.06)=56.54% by mass based on the total mass of the polysiloxane.

Images were reproduced and evaluated in the same way as in Example 1. Results obtained are shown in Table 3.

Example 4

In regard to the conductive elastic layer, the one used in Example 1 was used.

Next, as a treating agent for the surface layer, the condensation product I of the hydrolyzable silane compound as used in Example 1 was used, and 25 g of this condensation product I was added to a solvent of 65 g of ethanol. To the solution obtained, 10.0 g of an A-B type block copolymer 1 [trade name: MODIPER FS-710 (solid content: 15% by mass; available from Nippon Oil & Fats Co., Ltd.)] synthesized from an acrylic monomer and a silicon monomer was further added to prepare a condensation product-containing alcohol solution having a solid content of 7% by mass. Then, a cationic photopolymerization initiator was added in the same way as in Example 1 to obtain a surface layer coating solution 4.

As to the subsequent formation of the surface layer, it was formed in the same way as in Example 1 to produce a charging roller IV.

The surface layer formed by curing the surface layer coating solution 4 had a volume resistivity of $5.2\times10^{13}$ Ω·cm.

The charging roller IV produced had a total surface free energy ($\gamma^{Total}$) of 21.1 mJ/m$^2$. Here, the value of $\gamma^p+\gamma^h$ was 0.3 mJ/m$^2$.

Compositional analysis of the surface layer of the charging roller IV was also made in the same way as the compositional analysis of the surface layer of the charging roller I in Example 1. As the result, the content of oxyalkylene groups in the polysiloxane was found to be 14.21% by mass based on the total mass of the polysiloxane. The content of alkyl groups in the polysiloxane was found to be 6.94% by mass based on the total mass of the polysiloxane. The content of phenyl groups in the polysiloxane was found to be 12.57% by mass based on the total mass of the polysiloxane. The content of acrylic groups in the polysiloxane was found to be 8.19% by mass based on the total mass of the polysiloxane. Residues are considered to be siloxane moieties in the polysiloxane, and hence the content of siloxane moieties in the polysiloxane is 100.00−(14.21+6.94+12.57+8.19)=58.09% by mass based on the total mass of the polysiloxane.

Images were reproduced and evaluated in the same way as in Example 1. Results obtained are shown in Table 3.

Example 5

In regard to the conductive elastic layer, the one used in Example 1 was used.

Next, as a treating agent for the surface layer, the condensation product I of the hydrolyzable silane compound as used in Example 1 was used, and 25 g of this condensation product I was added to a mixed solvent of 8.35 g of 2-butanol and 65 g of ethanol. To the solution obtained, 1.65 g of a graft type copolymer 2 [trade name: LSI-60 (solid content: 45% by mass; available from Soken Chemical & Engineering Co., Ltd.)] synthesized from an acrylic monomer and a silicon monomer was further added to prepare a condensation product-containing alcohol solution having a solid content of 7% by mass. Then, a cationic photopolymerization initiator was added in the same way as in Example 1 to obtain a surface layer coating solution 5.

As to the subsequent formation of the surface layer, it was formed in the same way as in Example 1 to produce a charging roller V.

The surface layer formed by curing the surface layer coating solution 5 had a volume resistivity of $2.1\times10^{13}$ Ω·cm.

The charging roller V produced had a total surface free energy ($\gamma^{Total}$) of 25.6 mJ/m$^2$. Here, the value of $\gamma^p+\gamma^h$ was 3.5 mJ/m$^2$.

Compositional analysis of the surface layer of the charging roller V was also made in the same way as the compositional analysis of the surface layer of the charging roller I in Example 1. As the result, the content of oxyalkylene groups in the polysiloxane was found to be 13.58% by mass based on the total mass of the polysiloxane. The content of alkyl groups in the polysiloxane was found to be 6.64% by mass based on the total mass of the polysiloxane. The content of phenyl groups in the polysiloxane was found to be 12.02% by mass based on the total mass of the polysiloxane. The content of acrylic groups in the polysiloxane was found to be 3.59% by mass based on the total mass of the polysiloxane. Residues are considered to be siloxane moieties in the polysiloxane, and hence the content of siloxane moieties in the polysiloxane is 100.00−(13.58+6.64+12.02+3.59)=64.17% by mass based on the total mass of the polysiloxane.

Images were reproduced and evaluated in the same way as in Example 1. Results obtained are shown in Table 3.

Comparative Example 1

In regard to the conductive elastic layer, the one used in Example 1 was used.

Next, as a treating agent for the surface layer, the condensation product I of the hydrolyzable silane compound as used in Example 1 was used, and 25 g of this condensation product I was added to a mixed solvent of 10 g of 2-butanol and 65 g of ethanol. To the solution obtained, a cationic photopolymerization initiator was added in the same way as in Example 1 to obtain a surface layer coating solution 6.

As to the subsequent formation of the surface layer, it was formed in the same way as in Example 1 to produce a charging roller VI.

The surface layer formed by curing the surface layer coating solution 6 had a volume resistivity of $1.1\times10^{12}$ Ω·cm.

The charging roller VI produced had a total surface free energy ($\gamma^{Total}$) of 33.2 mJ/m$^2$. Here, the value of $\gamma^p+\gamma^h$ was 8.5 mJ/m$^2$.

Compositional analysis of the surface layer of the charging roller VI was also made in the same way as the compositional analysis of the surface layer of the charging roller I in Example 1. As the result, the content of oxyalkylene groups in the polysiloxane was found to be 15.09% by mass based on the total mass of the polysiloxane. The content of alkyl groups in the polysiloxane was found to be 7.37% by mass based on the total mass of the polysiloxane. The content of phenyl groups in the polysiloxane was found to be 13.36% by mass based on the total mass of the polysiloxane. Residues are considered to be siloxane moieties in the polysiloxane, and hence the content of siloxane moieties in the polysiloxane is 100.00−(15.09+7.37+13.36)=64.18% by mass based on the total mass of the polysiloxane.

Images were reproduced and evaluated in the same way as in Example 1. Results obtained are shown in Table 3.

Comparative Example 2

In regard to the conductive elastic layer, the one used in Example 1 was used.

A surface layer coating solution 7 was prepared in the following way.

61.54 g (0.256 mol) of phenyltriethoxysilane (PhTES) (trade name: KBE-103, available from Shin-Etsu Chemical Co., Ltd.) and 13.21 g (0.064 mol) of hexyltrimethoxysilane (HeTMS) (trade name: KBM-3063, available from Shin-Etsu Chemical Co., Ltd.) as hydrolyzable silane compounds and also 25.93 g of water and 45.95 g of ethanol were mixed. The mixture thus obtained was stirred at room temperature, and then heat-refluxed for 24 hours to obtain a condensation product II of the hydrolyzable silane compound.

25 g of this condensation product II was added to a mixed solvent of 5 g of 2-butanol and 65 g of ethanol. To the solution obtained, 5 g of an A-B type block copolymer 1 [trade name: MODIPER FS-710 (solid content: 15% by mass; available from Nippon Oil & Fats Co., Ltd.)] synthesized from an acrylic monomer and a silicon monomer was further added to prepare a condensation product-containing alcohol solution having a solid content of 7% by mass. Then, a cationic photopolymerization initiator was added in the same way as in Example 1 to obtain a surface layer coating solution 7.

As to the subsequent formation of the surface layer, it was formed in the same way as in Example 1 to produce a charging roller VII.

The volume resistivity of the surface layer was not measurable because the surface layer coating solution 7 was not cured by UV radiation.

The charging roller VII produced had a total surface free energy ($\gamma^{Total}$) of 25.6 mJ/m$^2$. Here, the value of $\gamma^p+\gamma^h$ was 3.5 mJ/m$^2$.

Compositional analysis of the surface layer of the charging roller VII was also made in the same way as the compositional analysis of the surface layer of the charging roller I in Example 1. As the result, the content of alkyl groups in the polysiloxane was found to be 7.25% by mass based on the total mass of the polysiloxane. The content of phenyl groups in the polysiloxane was found to be 26.72% by mass based on the total mass of the polysiloxane. The content of acrylic groups in the polysiloxane was found to be 3.41% by mass based on the total mass of the polysiloxane. Residues are considered to be siloxane moieties in the polysiloxane, and hence the content of siloxane moieties in the polysiloxane is 100.00−(7.25+26.72+3.41)=62.62% by mass based on the total mass of the polysiloxane.

Images were reproduced and evaluated in the same way as in Example 1. Results obtained are shown in Table 3.

TABLE 3

| | Example | | | | | Comparative Example | |
|---|---|---|---|---|---|---|---|
| | 1 | 2 | 3 | 4 | 5 | 1 | 2 |
| Condensation product I (mass %) | 93.8 | 93.8 | 93.8 | 88.3 | 93.8 | 100 | — |
| Condensation product II (mass %) | — | — | — | — | — | — | 93.8 |
| Copolymer 1 (mass %) | 6.2 | — | — | 11.7 | — | — | 6.2 |
| Copolymer 2 (mass %) | — | 6.2 | — | — | — | — | — |
| Copolymer 3 (mass %) | — | — | 6.2 | — | — | — | — |
| Copolymer 4 (mass %) | — | — | — | — | 6.2 | — | — |
| Surface free energy: | | | | | | | |
| $\gamma^{Total}$ (mJ/m$^2$) | 22.1 | 21.3 | 22.5 | 21.1 | 25.6 | 33.2 | 22.0 |
| $\gamma^{p+h}$ (mJ/m$^2$) | 1.2 | 0.5 | 0.3 | 0.3 | 3.5 | 8.5 | 2.3 |
| Volume resistivity (Ω · cm) | $1.3\times10^{12}$ | $4.3\times10^{12}$ | $6.8\times10^{12}$ | $5.2\times10^{13}$ | $2.1\times10^{13}$ | $1.1\times10^{12}$ | — |
| Running performance: | | | | | | | |
| Initial stage | AA | AA | AA | AA | AA | A | C |
| 1,000 sheets | AA | AA | AA | AA | A | B | — |

TABLE 3-continued

| | Example | | | | | Comparative Example | |
|---|---|---|---|---|---|---|---|
| | 1 | 2 | 3 | 4 | 5 | 1 | 2 |
| 2,000 sheets | AA | AA | A | AA | A | C | — |
| 3,000 sheets | AA | A | A | A | B | C | — |

As having been described above, according to the present invention, it can provide a charging member to the surface of which toners and external additives used in the toners can not easily cling even because of repeated use over a long period of time and which therefore enables charging and image reproduction which are stable over a long period of time, even when used in the DC contact charging method. According to the present invention, it can further provide a process cartridge and an electrophotographic apparatus which have such a charging member.

This application claims the benefit of Japanese Patent Application No. 2006-052870, filed Feb. 28, 2006, which is hereby incorporated by reference herein in its entirety.

The invention claimed is:

1. A charging member comprising a support, a conductive elastic layer formed on the support and a surface layer formed on the conductive elastic layer, wherein the surface layer contains a polysiloxane having an acrylic group and an oxyalkylene group, and wherein the polysiloxane is a polysiloxane obtained through the following steps (I), (II) and (III):

(I) the step of condensing by hydrolysis a hydrolyzable silane compound having a cationic-polymerizable group;

(II) the step of adding to the condensation product obtained in the step (I) a compound which is a block copolymer synthesized from an acrylic monomer and a silicon monomer; and (III) the step of cleaving the cationic polymerizable group to cross-link the hydrolytic condensation product obtained in the step (II).

2. The charging member according to claim 1, wherein the acrylic group in the polysiloxane is in a content of from 1.0% by mass or more to 20.0% by mass or less based on the total mass of the polysiloxane, the oxyalkylene group is in a content of from 4.0% by mass or more to 70.0% by mass or less based on the total mass of the polysiloxane, and the siloxane moiety is in a content of from 20.0% by mass or more to 95.0% by mass or less based on the total mass of the polysiloxane.

3. The charging member according to claim 2, wherein the polysiloxane further has an alkyl group and a phenyl group, where the oxyalkylene group in the polysiloxane is in a content of from 4.0% by mass or more to 30.0% by mass or less based on the total mass of the polysiloxane, the alkyl group in the polysiloxane is in a content of from 5.0% by mass or more to 30.0% by mass or less based on the total mass of the polysiloxane, the phenyl group in the polysiloxane is in a content of from 5.0% by mass or more to 30.0% by mass or less based on the total mass of the polysiloxane, the acrylic group in the polysiloxane is in a content of from 1.0% by mass or more to 20.0% by mass or less based on the total mass of the polysiloxane, and the siloxane moiety in the polysiloxane is in a content of from 20.0% by mass or more to 80.0% by mass or less based on the total mass of the polysiloxane.

4. The charging member according to claim 1, wherein step (I) comprises condensing by hydrolysis the hydrolyzable silane compound having a cationic-polymerizable group and a hydrolyzable silane compound having a structure represented by the following formula (1):

$$(R^{11})_a—Si—(OR^{12})_b \quad (1)$$

wherein $R^{11}$ represents a phenyl group substituted alkyl group or an unsubstituted alkyl group or an alkyl group substituted aryl group or an unsubstituted aryl group; $R^{12}$ represents a saturated or unsaturated monovalent hydrocarbon group; and a is an integer of 0 or more to 3 or less, b is an integer of 1 or more to 4 or less, and a+b is 4.

5. The charging member according to claim 4, wherein the a in the formula (1) is an integer of 1 or more to 3 or less, the b in the formula (1) is an integer of 1 or more to 3 or less, and one $R^{11}$ of a-number of $R^{11}$'s is a straight-chain alkyl group having 1 or more to 21 or less carbon atoms.

6. The charging member according to claim 1, wherein step (I) comprises condensing by hydrolysis the hydrolyzable silane compound having a cationic-polymerizable group, a hydrolyzable silane compound having an alkyl group and a hydrolyzable silane compound having a phenyl group.

7. The charging member according to claim 1, wherein the hydrolyzable silane compound having a cationic-polymerizable group is a hydrolyzable silane compound having a structure represented by the following formula (2):

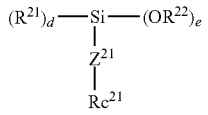

(2)

wherein $R^{21}$ represents a saturated or unsaturated monovalent hydrocarbon group; $R^{22}$ represents a saturated or unsaturated monovalent hydrocarbon group; $Z^{21}$ represents a divalent organic group; $Rc^{21}$ represents a cationic polymerizable group; and d is an integer of 0 to 2 or less, e is an integer of 1 or more to 3 or less, and d+e is 3.

8. The charging member according to claim 1, wherein the block copolymer synthesized from an acrylic monomer and a silicon monomer is an A-B type diblock copolymer.

9. The charging member according to claim 1, wherein the surface layer has a volume resistivity of from $10^{10}$ Ω·cm or more to $10^{16}$ Ω·cm or less.

10. The charging member according to claim 1, wherein, where the total surface free energy is defined to be γTotal (mJ/m2)=γd+γp+γh, 15<γTotal<30, and 0<γp+γh<5.

11. A process cartridge comprising an electrophotographic photosensitive member and a charging member for charging the surface of the electrophotographic photosensitive member electrostatically, which are integrally supported; the process cartridge being detachably mountable to the main body of an electrophotographic apparatus; wherein;

the charging member is the charging member according claim 1.

12. The process cartridge according to claim 11, wherein the charging member is disposed in contact with the electrophotographic photosensitive member.

13. An electrophotographic apparatus comprising an electrophotographic photosensitive member and a charging member for charging the surface of the electrophotographic photosensitive member electrostatically, wherein;

the charging member is the charging member according to claim 1.

14. The electrophotographic apparatus according to claim 13, wherein the charging member is disposed in contact with the electrophotographic photosensitive member.

15. The electrophotographic apparatus according to claim 13, wherein the charging member has a voltage applying unit for applying to the charging member a voltage of direct current voltage only.

* * * * *